United States Patent [19]

Strate et al.

[11] Patent Number: 5,071,356

[45] Date of Patent: Dec. 10, 1991

[54] MODULAR TERMINAL ARRANGEMENT

[75] Inventors: Klaus Strate, Detmold; Juergen Pampel, Bad Salzuflen, both of Fed. Rep. of Germany

[73] Assignee: C. A. Weidmueller GmbH & Co., Detmold, Fed. Rep. of Germany

[21] Appl. No.: 514,212

[22] Filed: Apr. 25, 1990

[30] Foreign Application Priority Data

May 12, 1989 [EP] European Pat. Off. ..... 89108552.4

[51] Int. Cl.[5] ..... H01R 9/26; H01R 31/08

[52] U.S. Cl. ..... 439/49; 439/511; 439/716; 439/721

[58] Field of Search ..... 439/715, 716, 721, 723, 439/49, 507, 511

[56] References Cited

U.S. PATENT DOCUMENTS

| | | | |
|---|---|---|---|
| 4,171,861 | 10/1979 | Hohorst | 439/716 |
| 4,795,376 | 1/1989 | Franke et al. | 329/715 |
| 4,940,431 | 7/1990 | Hennemann | 439/715 |

FOREIGN PATENT DOCUMENTS

| | | | |
|---|---|---|---|
| 0222030 | 11/1985 | European Pat. Off. . | |
| 2736664 | 2/1978 | Fed. Rep. of Germany . | |
| 2357052 | 3/1983 | Fed. Rep. of Germany . | |
| 3312002 | 5/1984 | Fed. Rep. of Germany . | |
| 3526494 | 1/1987 | Fed. Rep. of Germany | 439/716 |
| 3629796 | 12/1987 | Fed. Rep. of Germany | 439/715 |
| 3625240 | 1/1988 | Fed. Rep. of Germany | 439/716 |

*Primary Examiner*—Gary F. Paumen
*Assistant Examiner*—Kevin J. Carroll
*Attorney, Agent, or Firm*—Laubscher, Presta & Laubscher

[57] ABSTRACT

A modular terminal arrangement for connecting a conductor to a conductive cross bar (6), including a housing (1) formed of insulating material and arranged to transversely receive the cross bar, the housing including a terminal (2) adapted for connection with the conductor, a bus bar (4) connected at one end with the terminal and extending at its other end adjacent the cross bar, and a bridging member (7) adapted to connect the other end of the bus bar with the cross bar. The bridging member includes a pair of parallel spaced leg portions, the bridging member being displaceable between a connecting position in which the leg portions electrically engage the cross rail and extend at their free extremities in electrical engagement within an opening contained in the cross bar other end, and a disengaged position in which the leg portions are isolated from the bus bar.

10 Claims, 2 Drawing Sheets

MODULAR TERMINAL ARRANGEMENT

STATEMENT OF THE INVENTION

A modular so-called "initiator" terminal arrangement is disclosed for connecting at least one electrical conductor with a cross rail, using a conductive bridging member that is displaceable between disconnected and connected positions relative to a bus bar, the bridging member in the connecting position extending at one end in conductive relation within an opening contained in the bus bar.

BRIEF DESCRIPTION OF THE PRIOR ART

Modular terminal arrangements are well known in the patented prior art. As shown in German Patent No. 3,312,002Cl, in order to switch specific terminals in a sequence of series terminals of the same potential, there are provided cross-connectors in which flat plugs are moulded in a combtooth-like arrangement to the cross bus bar or rail passing through the modular terminal arrangement, wherein the flat plugs are plugged into holes of the bus bar of the series terminals which are to be switched to this potential. Non-essential flat plugs corresponding to those series terminals in the system which are not to be switched to this potential are broken off from the cross-bar via a desired break-point during assembly. The known design is, on the one hand, simple in its assembly, but, on the other hand, not very flexible in its range of application. For example, following its first assembly in a switchgear, alterations are no longer possible. When the circuitry is changed, a combtooth-like cross-connector must, as a rule, be used.

Furthermore, if a cross-connection is to be disconnected, the entire comb-like cross-connector must be disassembled so that practically the entire circuitry and the units to be powered that are connected thereto are switched off. In the case of known cross-connectors, the flat plugs are relatively resilient adjacent their lower end, which lower end interacts with the perforated bus bar, by means of an expansion slot so that they can be plugged into the hole of the bus bar with slight compression. However, the contact force that can be obtained thus is limited, owing to the fact that normally during assembly, a plurality of flat plugs must be simultaneously plugged in or when the connection is disconnected, they must be pulled out again.

Furthermore, there is disclosed in German Patent No. 2736664Al a cross-connector arrangement in which the bus bars for series terminals arranged in a row have two plug openings oriented in sequential depth. A plurality of U-shaped cross-connector plug elements are provided as the cross-connectors, which are designed like a flat plug, wherein the one leg of the U-shaped plug connected is plugged into the hole of a bus bar and the other leg into the adjacent hole of the bus bar of the neighboring series terminal. Thus, to make the desired cross-connections, such a cross-connector element must always be plugged in complete succession from series terminal to series terminal. The drawback here is also to a significant degree the low flexibility. All series terminals of the arrangement must be switched to the same potential, since if one such cross-connector is left out, the series terminals that follow in the current flow direction can no longer be switched to even this potential due to this interruption. If a cross-connector in an existing arrangement is disconnected, all of the series terminals that follow behind are automatically without power.

Finally there exist cross-connectors in which a plurality of spacing or connecting elements extend from one cross bar to the bus bars of the series terminals, in part also over desired break-points, wherein the elements extending to the bus bars bear a connecting screw and the bus bar has a tapped hole (See German Patent No. 23 57 052 Al). Such cross-connectors are expensive to manufacture, especially since they require a tapped hole in the bus bar. The manufacture of screw connections is time consuming. Here, too, a conceivably low flexibility is given, since a cross-strip that is installed once in modifying a circuit cannot be reused. Even disconnecting individual cross-connecting connections of the affected series terminals is not logically possible. Therefore, the present invention is based on the problem of providing a class of modular terminal arrangements which is flexible to a significant degree in the region of the cross-connector with respect to modifications of the circuitry and with respect to a desired disconnection.

The solution of the invention for a modular terminal arrangement of the generic kind lies in the fact that the flat plugs are designed as disconnect plugs that are isolated from the cross bus bar and can be mounted on it.

These disconnect plugs can be mounted in any arbitrary arrangement on the cross-bar leading over the modular terminal arrangement and, as in the case of prior art flat plugs, can also be plugged with their bottom ends into the holes of the bus bars in question. From the point of view of assembly, this mounting and plugging in is a simple procedure. The individual cross-connecting connections of the individual series terminals remain independent of one another. If a modification of the circuitry is desired, the same separating plugs can be connected in series, wherever necessary, at other series terminals. It is also possible in a simple manner to a significant degree to open an individual cross-connecting connection of a series terminal in question in the sense of isolating the circuit without having any impact on the power supply of all of the other series terminals in the arrangement, even those that are switched to the same potential via this cross-connector. Thus, the cross-connector flat plug has practically a dual function. Namely, it serves simultaneously as a separating element for the series terminal in question and turns it, according to its nature, into a series separating terminal without it having to have the otherwise normal separating pushers or the like. Owing to the fact that the flat plug is designed so as to be able to mount on the cross-strip, it is, therefore, to be designed so as to be able to expand in a flexible manner during the mounting procedure on the cross-strip, wherein in connection with the hole of the bus bar in question a very high spring contact force can be obtained for the plugged-in flat or disconnect plug, as is the case, on the whole, in many applications, for example with a high vibrational load and/or downward pointing arrangement of the modular terminal arrangement.

The design of the invention is suitable to a remarkable degree for so-called initiator modular terminal arrangements. In such initiator modular terminal arrangements (as shown, for example in European Patent No. 222 030 Al) three-tier terminals are used. In this case in forming the series in two tiers only the first series terminal of the sequence is connected to the positive terminal and the negative terminal of the voltage source. Starting from the first series terminal, the conductance is exclusively via cross-connectors into the individual tiers. The conductors, outgoing into the two tiers, lead to initiators and from them back, whereas the remaining tier is then charged by the initiator over a control line and the reverse connections of this tier are then connected to the signal generators.

Precisely, with such initiator terminal arrangements it has been demonstrated that there is a need to separate the individual initiators again and again from the circuit independently of one another, in particular for test purposes. Owing to the design of the present invention, it is now possible due to the dual function of cross-connector and separating element that is provided by the invention to utilize also for the separating function the requisite cross-connectors of the invention in one or the other or both tiers; to which end the flat or separating plug in the tier that is under consideration and belonging to the series terminals responsible for the initiator under discussion is pulled out in an extremely simple manner for separating purposes.

SUMMARY OF THE INVENTION

Accordingly, a primary object of the present invention is to provide a modular terminal arrangement for connecting a conductor with a cross bus bar or strip, including a housing of insulating material transversely receiving the cross bar, a terminal on the housing adapted for connection with the conductor, and means connecting the terminal with the cross bar, including a bus bar connected at one end with the terminal, and extending at its other end adjacent the cross bar, and a bridging member operable between connected and disconnected positions relative to the cross bar and the bus bar one end, the bridging member in the connected position being in electrical contact with the cross bar and extending at its free end in conductive relation within an opening contained in the bus bar one end.

According to another object of the invention, the housing contains a plurality of bus bars for selective connection by bridging members with a plurality of cross bars, respectively, or a plurality of bus bars adapted for selective connection by the bridging members with a common cross bar. Support rail means serve to mount the housing in a given relationship relative to the cross bars. Terminals are provided on the housing for connecting the external conductors with the bus bars, respectively.

According to a further object of the invention, the bridging member is formed of a U-shaped configuration and includes a pair of spaced parallel leg portions that are normally biased apart into conductive engagement with the bus bar opening. Internal lugs are provided for engagement with the cross bar upon which the bridging member is mounted, and handle means formed of insulating material are provided for manually displacing the bridging members between the engaged and disengaged positions. External lugs on the bridging member cooperate with corresponding grooves on the housing to positively maintain the bridging member in its connected and disconnected positions.

BRIEF DESCRIPTION OF THE DRAWING

Other objects and advantages of the invention will become apparent from a study of the following specification when viewed in the light of the accompanying drawing, in which.

DETAILED DESCRIPTION

Figure 1:
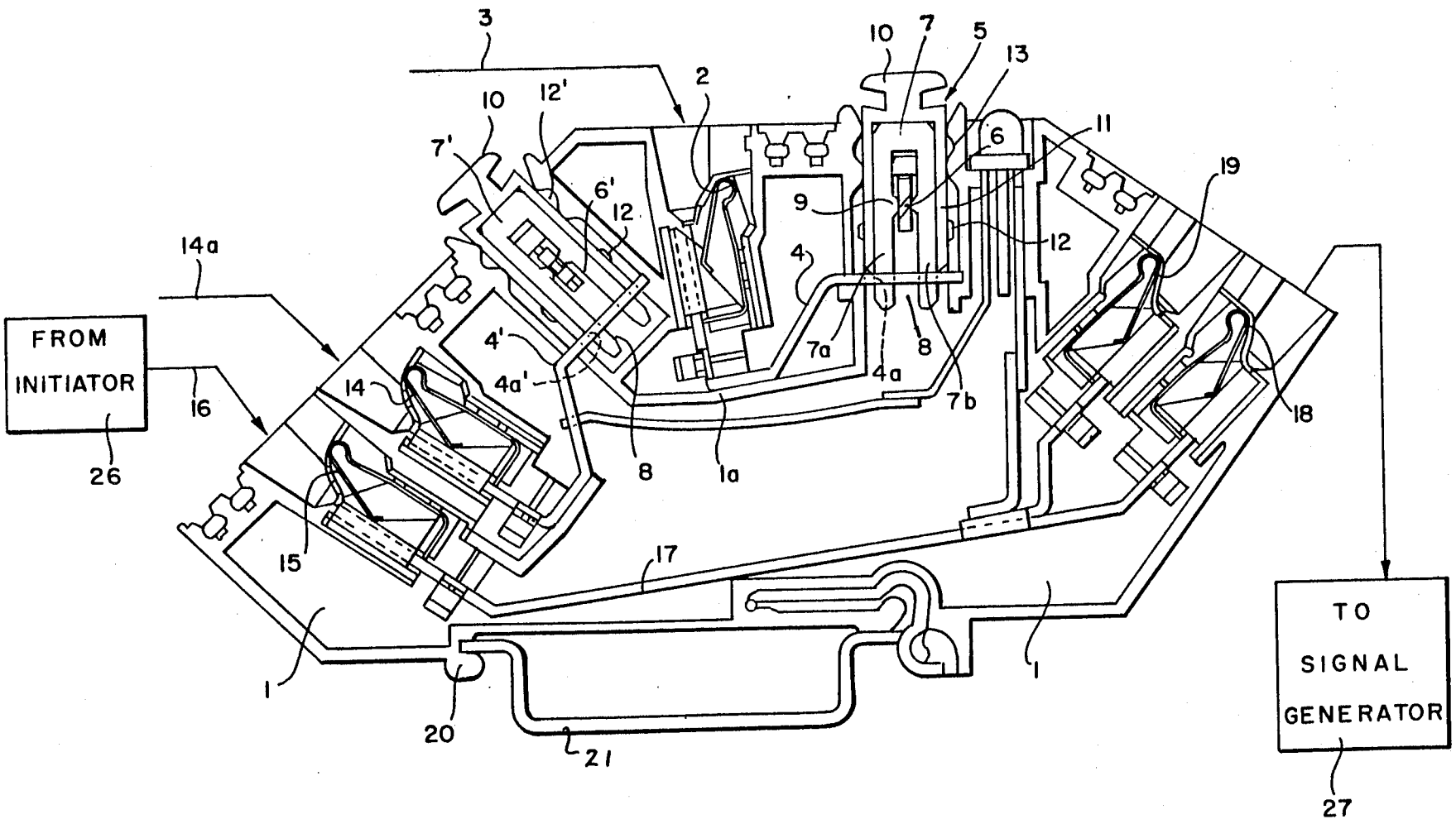
FIG. 1 is a somewhat diagrammatic view of one housing section illustrating the manner in which a plurality of conductors may be connected with different cross bars, respectively.

Referring first more particularly to FIG. 1, the modular terminal arrangement of the present invention includes a housing 1 formed of a suitable electrical insulation material and provided with a first electrical terminal 2 adapted for connection with an electrical connector 3. The housing 1 transversely receives a cross bar 6. In order to electrically connect the first terminal 2 with the cross bar 6, there is provided a bus bar 4 that is connected at one end with the electrical connector 2 and which terminates at its other end adjacent and spaced from the cross bar 6. In accordance with the present invention, a generally U-shaped conductive bridging member 7 is mounted on portions *7a, 7b* that extend in conducting relation within a corresponding opening *4a* contained in the adjacent end of the bus bar 4. When in the connected position illustrated in FIG. 1, the bridging member 7 has internal nub portions 9 that engage the adjacent surfaces of the cross bar 6. In order to move the bridging member 7 to a disconnected position relative to the bus bar 4, the bridging member 7 is mounted in a frame 11 formed of electrical insulating material and having a handle portion 10, which frame extends partially around the bridging member 7. The frame 11 is provided with first external stop lugs 12 that are arranged to cooperate with stationary stop grooves 13 on the housing when the bridging member is elevated to the disconnected position relative to the bus bar 4, thereby maintaining the bridging member in the disconnected position. Furthermore, the frame 11 is provided with a second pair of external nubs 12' that engage the stop grooves 13 to retain the bridging member in the illustrated connected position.

In accordance with another feature of the invention, the housing 1 is arranged to receive a second cross bar 6' that is adapted for connection with a second conductor 14a via second input terminal means 14, second bus bar 4', and a second bridging member 7' having leg portions that extend both in engagement with the cross bar 6' and in electrical contact within an opening 4a' contained in the second bus bar 4' The bus bars 4 and 4' are electrically isolated from each other by the internal wall portion la of the housing.

In the case of a so-called "initiator" terminal arrangement, control signals are supplied to special signal generators (not shown), and to this end, the housing is provided with a further input terminal 15 adapted for connection with the conductor 16 from the initiator 26. The input terminal is connected with the output terminals 18 and 19 via a further bus bar 17, thereby to supply signals from the initiator to the signal generator means 27.

Preferably, the housing 1 is supported relative to the cross bars 6 and 6' by means of a fixed support rail 21 upon which the housing 1 is mounted.

Figure 2:
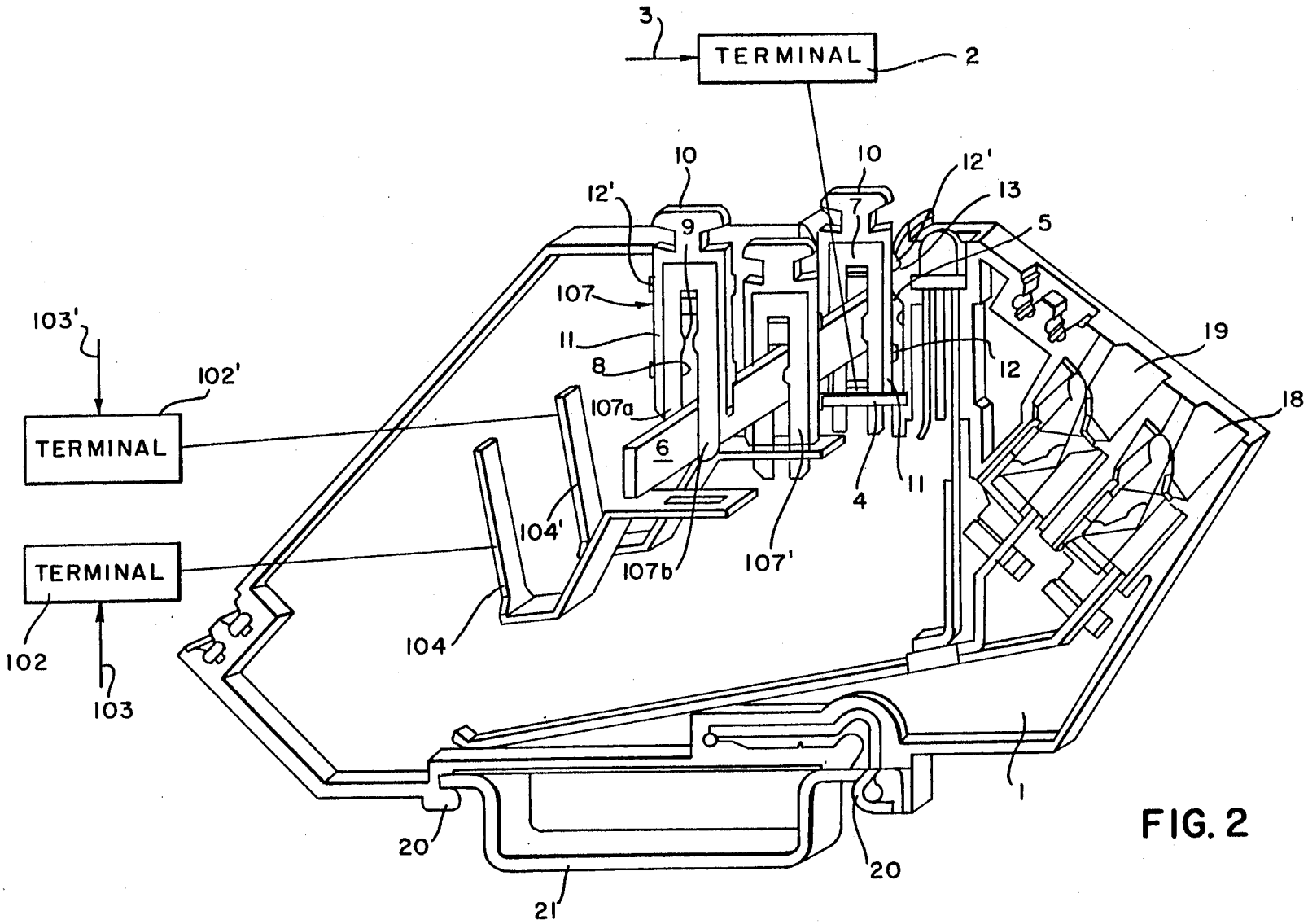
FIG. 2 is a somewhat perspective view illustrating the manner in which a plurality of conductors may be connected with a single cross bar.

As shown in FIG. 2, the modular terminal arrangement of the present invention is also operable to connect a plurality of conductors to a single cross bar 6. Thus, the housing is provided with terminals 102 and 102' for connection with input conductors 103 and 103', respectively, which terminals are then connected with the bus bars 104 and 104' which contain openings for receiving the bridging members 107 and 107', respectively. As shown in FIG. 2, the bridging member 107 is elevated to the disconnect position by operation of the handle 10, thereby to isolate the lower extremities of the leg portions 107*a* and 107*b* from the opening 104*a* of the associated bus bar 4. The other two bridging members 107' and 7 are illustrated, as being electrically connected with the bus bars 104' and 4, respectively.

Thus, in the illustrated embodiments, it is possible to connect and disconnect individual terminals from the associated cross bars, thereby controlling not only the supply of current to the module, but also a return of the current, for example for test purposes.

While in accordance with the provisions of the Patent Statutes the preferred form and embodiment of the invention has been illustrated and described, it will be apparent to those skilled in the art that various modifications may be made without deviating from the inventive concepts set forth above.

What is claimed is:

1. An electrical modular terminal arrangement for connecting at least one conductor (3) to at least one conductive cross bar (6), comprising:

(a) a housing (1) formed of insulating material, said housing being arranged to transversely receive the cross bar (6);

(b) a first electrical input terminal (2) arranged on said housing; and (c) means connecting said input terminal with said cross bar, including:

(1) a bus bar (4) connected at one end with said first input terminal, said bus bar extending at its other end to a position adjacent and spaced from said cross bar, said other end containing an opening (4*a*) opposite said cross bar; and (2) bridging means for electrically connecting said cross bar with said bus bar, said bridging means including a conductive bridging member (7) operable between a connected position in conductive engagement with both said cross bar and said bus bar, and a disconnected position in non-conductive relation relative to said cross bar and said bus bar, said bridging member in said connected position extending in electrical engagement within said bus bar opening, and in said disconnected position being isolated and spaced from said bus bar opening.

2. Apparatus as defined in claim 1, wherein said bridging member includes a pair of parallel spaced resilient leg portions (7*a*,7*b*) that are normally biased apart toward engagement with opposite wall portions of said bus bar opening, respectively.

3. Apparatus as defined in claim 2, wherein said bridging member leg portions include intermediate their ends inwardly directed nubs (9) that engage opposite surfaces of said cross bar, respectively, when said bridging member is in the connected position.

4. Apparatus as defined in claim 1, wherein said bridging member includes a handle (10) formed by insulating material for manually displacing said bridging member between said connected and disconnected positions.

5. Apparatus as defined in claim 4, wherein said handle comprises a portion of an insulating frame (11) that extends partially around said bridging member.

6. Apparatus as defined in claim 1 and further wherein said bridging member includes external first stop lugs (12) that extend within corresponding grooves (13) contained in said housing when said bridging member is in the disconnected position, thereby to retain said bridging member in the disconnected position.

7. Apparatus as defined in claim 6, and further including a second cross bar (6') extending transversely of said housing; and further including second terminal means (14) on said housing, a second bus bar (4') electrically isolated from said first bus bar, and further including a conductive second bridging member (7') operable between a connected position electrically connecting said second cross bar with said second bus bar, and a disconnected position in which said second cross bar is disconnected from said second bus bar, said bridging member extending at one end in electrical engagement within an opening (4*a'*) contained in said second bus bar when in said connected position.

8. Apparatus as defined in claim 7, and further including third (15) and fourth (18) electrical terminals on said housing, and third bus bar means (17) directly connecting said third and fourth terminal means.

9. Apparatus as defined in claim 1, and further including a support rail (21) extending parallel with and spaced from said cross bar, and means for supporting said housing on said support rail.

10. Apparatus as defined in claim 1, and further including a plurality of other electrical terminals (102, 102') arranged in said housing, a plurality of other bus bars (104, 104') connected at one end with said other terminals, respectively, and a plurality of other bridging members (107, 107') electrically connecting said cross bar with openings contained in the other ends of said other bus bars, respectively.

* * * * *